US009097458B2

(12) United States Patent
Buchstab et al.

(10) Patent No.: US 9,097,458 B2
(45) Date of Patent: Aug. 4, 2015

(54) REFRIGERATION DEVICE COMPRISING A WATER TANK

(75) Inventors: Martin Buchstab, Bopfingen (DE); Irene Dumkow, Sontheim (DE); Adolf Feinauer, Giengen (DE); Klaus Flinner, Zöschingen (DE); Bernd Heger, Haunsheim (DE); Peter Nalbach, Kirchheim/Nabern (DE); Kasim Yazan, Ulm (DE)

(73) Assignee: BSH HAUSGERÄTE GMBH, Munich (DE)

( * ) Notice: Subject to any disclaimer, the term of this patent is extended or adjusted under 35 U.S.C. 154(b) by 704 days.

(21) Appl. No.: 12/085,939

(22) PCT Filed: Oct. 31, 2006

(86) PCT No.: PCT/EP2006/067964

§ 371 (c)(1),
(2), (4) Date: May 28, 2008

(87) PCT Pub. No.: WO2007/062952

PCT Pub. Date: Jun. 7, 2007

(65) Prior Publication Data

US 2009/0044560 A1 Feb. 19, 2009

(30) Foreign Application Priority Data

Nov. 30, 2005 (DE) ..... 10 2005 057 165

(51) Int. Cl.

| | |
|---|---|
| ***F25D 3/00*** | (2006.01) |
| ***F25D 23/12*** | (2006.01) |
| ***F25D 17/06*** | (2006.01) |
| *F25D 23/02* | (2006.01) |

(52) U.S. Cl.

CPC ..... *F25D 23/126* (2013.01); *F25D 17/062* (2013.01); *F25D 23/028* (2013.01); *F25D 2317/061* (2013.01); *F25D 2317/062* (2013.01); *F25D 2323/122* (2013.01)

(58) Field of Classification Search

CPC ..... F25D 23/04; F25D 2317/061; F25D 2317/062; F25D 2317/0654; F25D 2317/0672

USPC ..... 62/186–187, 337–339, 407–409, 377, 62/451, 406

See application file for complete search history.

(56) References Cited

U.S. PATENT DOCUMENTS

| | | | | | |
|---|---|---|---|---|---|
| 2,229,850 | A | * | 1/1941 | Hoskins | 62/299 |
| 2,902,838 | A | * | 9/1959 | Nichols | 62/244 |
| 2,937,511 | A | * | 5/1960 | Mann | 62/198 |
| 3,934,758 | A | | 1/1976 | Kipp | |
| 4,704,874 | A | * | 11/1987 | Thompson et al. | 62/187 |

(Continued)

FOREIGN PATENT DOCUMENTS

JP 2005-24119 1/2005

OTHER PUBLICATIONS

International Search Report PCT/EP2006/067964.

*Primary Examiner* — Cassey D Bauer
(74) *Attorney, Agent, or Firm* — Nixon & Vanderhye P.C.

(57) ABSTRACT

A refrigeration device comprising a heat-insulated housing, which contains a storage compartment, a water tank, a fan for propelling a stream of cold air that passes through an evaporator and a distribution unit for the controlled distribution of the stream of cold air along at least two circulation paths, the first of which is in closer thermal contact with the water tank than the second.

14 Claims, 3 Drawing Sheets

(56) References Cited

U.S. PATENT DOCUMENTS

| | | | | |
|---|---|---|---|---|
| 4,970,871 | A | 11/1990 | Rudick | |
| 6,957,549 | B2 * | 10/2005 | Kim et al. | 62/408 |
| 2005/0011219 | A1 * | 1/2005 | Asan et al. | 62/440 |
| 2005/0039482 | A1 | 2/2005 | Kim et al. | |
| 2005/0061016 | A1 | 3/2005 | Lee et al. | |
| 2005/0061018 | A1 | 3/2005 | Kim et al. | |
| 2005/0160756 | A1 * | 7/2005 | Lee et al. | 62/340 |
| 2006/0096310 | A1 * | 5/2006 | Lee | 62/348 |

* cited by examiner

REFRIGERATION DEVICE COMPRISING A WATER TANK

This application is a U.S. National Phase of International Application No. PCT/EP2006/067964, filed Oct. 31, 2006, which designates the U.S. and claims priority to German Application No. 102005057165.4, filed Nov. 30, 2005, the entire contents of each are hereby incorporated by reference.

BACKGROUND OF THE INVENTION

The present invention relates to a refrigeration appliance having a heat-insulating housing, a storage compartment for refrigerated items that is accommodated in the housing, and a water reservoir. A refrigeration appliance of this kind is known from WO 03/033976 A1.

The water reservoir of such a refrigeration appliance generally serves for supplying a drinking water dispenser which is mounted on an external surface of the housing of the refrigeration appliance and is in thermal contact with the storage compartment in order to ensure that its contents, and hence the drinking water drawn off at the dispenser, are cooled.

In order to prevent the contents of the reservoir from freezing at temperatures of the storage compartment below 0° C., the reservoir in the known refrigeration appliance is incorporated in an insulating layer of the door so that it assumes a temperature between that of the storage compartment and the ambient temperature.

Embedding the reservoir in insulation material on all sides means that when water has been drawn off and the reservoir is replenished with fresh water, it takes a very long time for the contents of the reservoir to assume their stationary temperature once more. Furthermore, the storage compartment must have a considerably lower temperature than the desired stationary temperature of the reservoir so that the latter temperature reaches a value that is acceptable to the user; in other words, the storage compartment must be at freezing temperature. A further problem is that the temperature in the reservoir is dependent on the ambient temperature of the refrigeration appliance.

BRIEF SUMMARY OF THE INVENTION

The object of the present invention is to create a refrigeration appliance with a water reservoir which permits the temperature of the water reservoir to be set independently of the ambient temperature and the temperature of the storage compartment.

The object is achieved according to the invention by means of a refrigeration appliance having a heat-insulating housing, a storage compartment for refrigerated items that is accommodated in the housing, and a water reservoir, said refrigeration appliance having a blower for propelling a cold air stream running via an evaporator and a distributor device serving for the controlled distribution of the cold air stream over at least two circulation paths, of which the first is in closer thermal contact with the water reservoir than the second. By regulating the cold air throughput rates over the two circulation paths it is possible to keep both the storage compartment and the water reservoir at setpoint temperatures which can be specified independently of one another.

In the simplest case the control can be set permanently by the manufacturer or user of the refrigeration appliance, e.g. by adjusting passage cross-sections of the two circulation paths, in order to obtain a volume distribution of the cold air stream over the two circulation paths that results in a desired cooling of the water reservoir.

Alternatively the water reservoir can also be assigned a temperature sensor, and the distributor device is set up to regulate the cold air throughput over the first circulation path as a function of the temperature measured by the temperature sensor.

A sensor for detecting or measuring the volumetric flow rate of water through the reservoir can also be provided in order to determine the cooling requirement of the reservoir in a simple manner.

According to a simple embodiment, the water reservoir is disposed in the storage compartment, and the storage compartment has at least two inlet apertures for the cold air stream, of which one, which is to be assigned to the first circulation path, is oriented toward the reservoir. With a layout of this kind, the water reservoir is blasted with fresh cold air via said outlet aperture before the air disperses in the storage compartment, and in this way the reservoir can be preferentially cooled. In other words, although the water reservoir is contained in the storage compartment, it can assume a temperature which lies significantly below the average temperature of the storage compartment.

In order to avoid a strong influx of heat into the reservoir from the surrounding storage compartment, the reservoir can be disposed directly on a wall of the heat-insulating housing or in a recess in said wall.

According to a second embodiment, the reservoir is disposed outside of the storage compartment, and the first circulation path has an upstream section which runs via the reservoir and a downstream section which runs through the storage compartment. In this case, too, the reservoir can be cooled more strongly than the storage compartment. Air which has already been warmed up somewhat at the reservoir can subsequently be used also for cooling the storage compartment. This is beneficial in particular when the temperature difference between reservoir and storage compartment is great, e.g. when the storage compartment has a larder compartment through which the first circulation path runs after passing through the reservoir.

If the temperature of the reservoir is only slightly lower than that of the storage compartment, or if the temperature of the storage compartment is lower than that of the reservoir, it is not beneficial to route air warmed at the reservoir into the storage compartment. In this case the reservoir is beneficially disposed outside of the storage compartment, and the first circulation path runs via the reservoir, bypassing the storage compartment. A layout of this kind can also be used if the reservoir temperature is lower than that of the storage compartment. A refrigeration appliance housing in which the first circulation path is separated from the storage compartment is therefore suitable both for a refrigerator and for a freezer and on account of this versatility can be economically mass-produced.

In these latter cases the reservoir is preferably incorporated in an insulating layer of a wall of the housing.

In such an arrangement the first circulation path can run through between the storage compartment and the reservoir. In order to keep the thickness of the wall small, it can also be beneficial if the first circulation path runs at an angle delimited on one side by the reservoir and on the other side by the storage compartment.

BRIEF DESCRIPTION OF THE DRAWINGS

Further features and advantages of the invention will emerge from the following description of exemplary embodiments with reference to the attached figures, in which.

DETAILED DESCRIPTION OF THE PRESENT INVENTION

Figure 1:
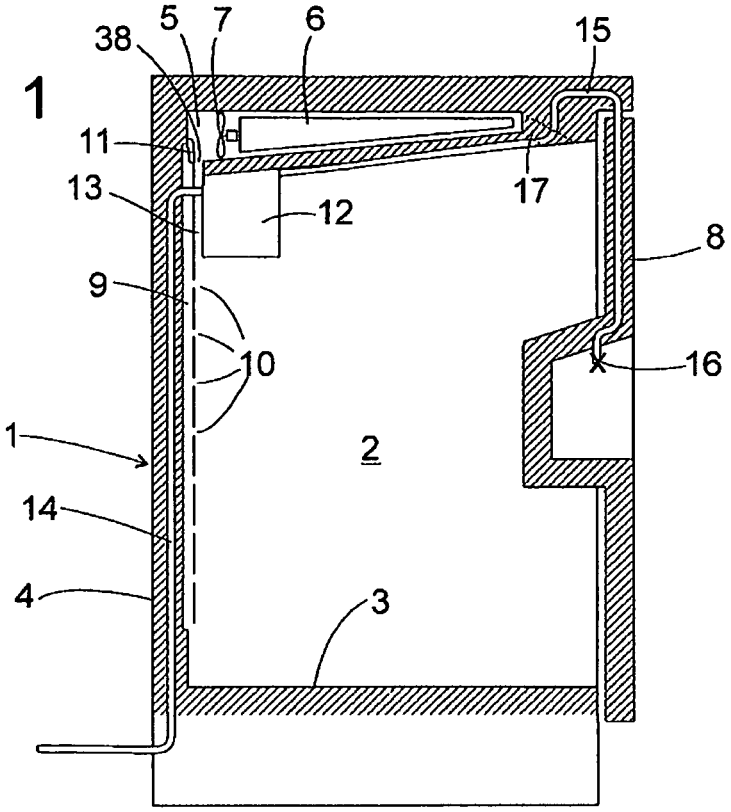
FIG. 1 shows a schematic section through a refrigeration appliance according to a first embodiment of the invention.

FIG. 1 shows a schematic section through a refrigerator in no-frost design which represents a first exemplary embodiment of the invention. A carcass 1 of the refrigerator is assembled in a manner known per se from a solid outer skin and an inner container 3 delimiting a storage compartment 2 and deep-drawn as a single piece from plastic, and a space between outer skin and inner container 3 is filled with insulating foam material.

An evaporator 6 and a blower 7 are contained in a chamber 5 separated from the storage compartment 2. An inlet aperture 17 is formed between the chamber 5 and the storage compartment 2 at an end of the chamber 5 facing the door 8. Since the inlet aperture lies outside the sectional plane of the figure, it is indicated in the latter as a dashed outline. Extending adjacent to the rear wall of the carcass 1 is a distributor channel 9 which communicates on the one side with the chamber 5 and on the other side with the storage compartment 2 via a plurality of vertically distributed apertures 10. Attached at the inlet of the distributor channel 9 is a flap 11 which in the position shown closes the distributor channel 9 and reveals an aperture 38 which leads into the storage compartment 2 adjacent to a water reservoir 12. The rear walls of the reservoir 12 and of the inner container 3 delimit a reservoir cooling duct 13 through which cold air flows after passing through the aperture 38 before it disperses in the storage compartment 2.

A supply conduit 14 of the reservoir is provided for the purpose of being connected to a public drinking water network; a delivery conduit 15 is routed through a hinge of the door 8 to a drinking water dispenser 16 disposed centrally in the door 8. The supply conduit 14 can simultaneously serve to supply an ice maker, though this is not shown in the figure because it is not directly related to the invention.

In the schematic of FIG. 1 it is shown that the reservoir cooling duct 13 extends along the rear side of the roughly cube-shaped reservoir 12 placed in the storage compartment 2. In order to restrict an exchange of heat of the reservoir 12 with the rest of the storage compartment 2, the reservoir cooling duct 13 can additionally extend also via side walls of the reservoir 12 outside of the sectional plane of the figure, or the reservoir 12 can extend in the width direction of the carcass 1 in each case from one side wall to the opposite one in order to immediately adjoin its insulating layer and so prevent an exchange of heat with the rest of the storage compartment by way of the side walls.

Figure 2:
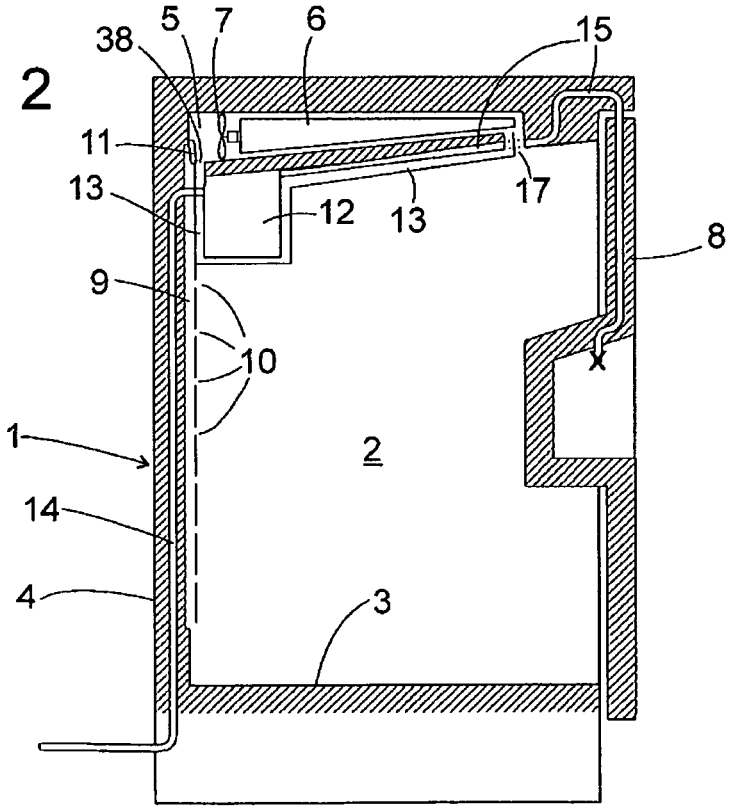
FIG. 2 shows a section according to a second embodiment.

In a variation shown in FIG. 2 the reservoir cooling duct 13 is also routed along the underside and front side of the reservoir 12 and extends from there as far as the inlet aperture 17 of the chamber 5. This design permits the cold air used for cooling the reservoir 12 to be routed totally separately from that which flows through the rest of the storage compartment 2. In contrast to the embodiment of FIG. 1, this means that no temporary warming-up of the storage compartment 2 can occur if a large amount of water is drawn off from the reservoir 12 and replaced by warm water, with the result that the air in the reservoir cooling duct 13 becomes warmer than in the rest of the storage compartment 2.

Figure 3:
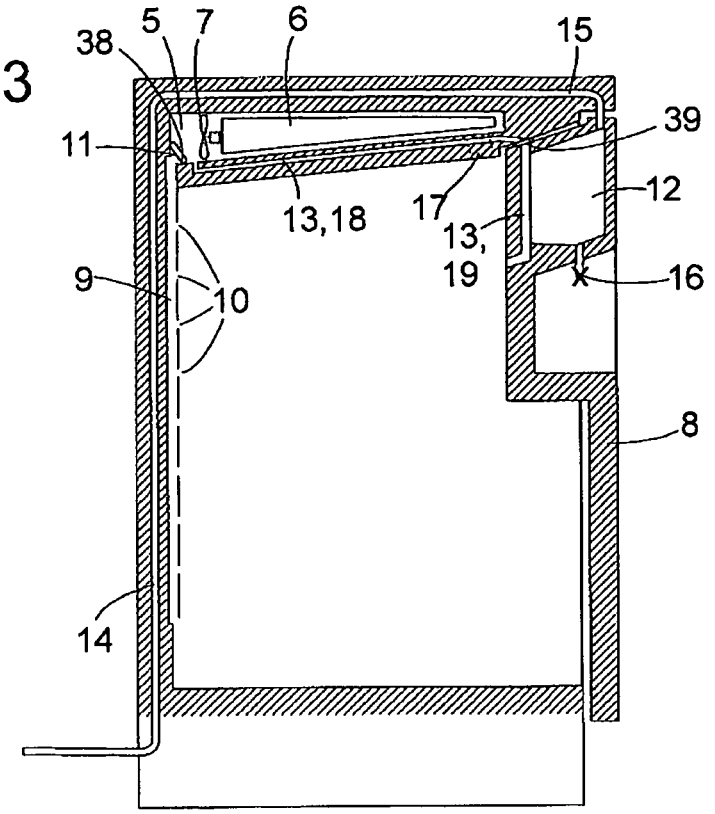
FIG. 3 shows a section according to a third embodiment.

FIG. 3 shows a third embodiment of the refrigeration appliance according to the invention. As with the previously considered embodiments, a chamber 5 containing evaporator 6 and blower 7 is divided off in the carcass 1 above the storage compartment 2, and a flap 11 is movable between a position shown in the figure, in which it closes a distributor channel 5 running along the rear wall of the storage compartment 2 and opens a reservoir cooling duct 13, and a position in which it opens the distributor channel 9 and closes the reservoir cooling duct 13. In this embodiment the reservoir cooling duct 13 comprises a first section 18, which runs inside the carcass 1 to the door 8, and a second section 19, which runs in the interior of the door 8 between the reservoir 12 and the storage compartment 2. The sections abut each other at two inclined surfaces of the carcass 1 and the door 8 which lie opposite and parallel to each other when the door 8 is closed and at the same time hold a rubber seal 39 compressed.

In the schematic shown in FIG. 3 the second section 19 leads under the reservoir 12 into the storage compartment 2. Alternatively it would be possible to route the second section 19 upward again inside the door 8 and back to the inlet aperture (not shown) of the chamber 5 in order in this way to implement mutually separate flow paths through the storage compartment 2 on the one hand and along the reservoir 12 on the other, and by this means prevent air heated at the reservoir above the temperature of the storage compartment 2 being emitted into the storage compartment 2.

Instead of the mounting of the reservoir 12 in the door 8 above the drinking water dispenser 16, as shown in FIG. 3, it would also be conceivable to place an ice maker in this area and to arrange the reservoir instead in the door at the level of the drinking water dispenser 16.

Figure 4:
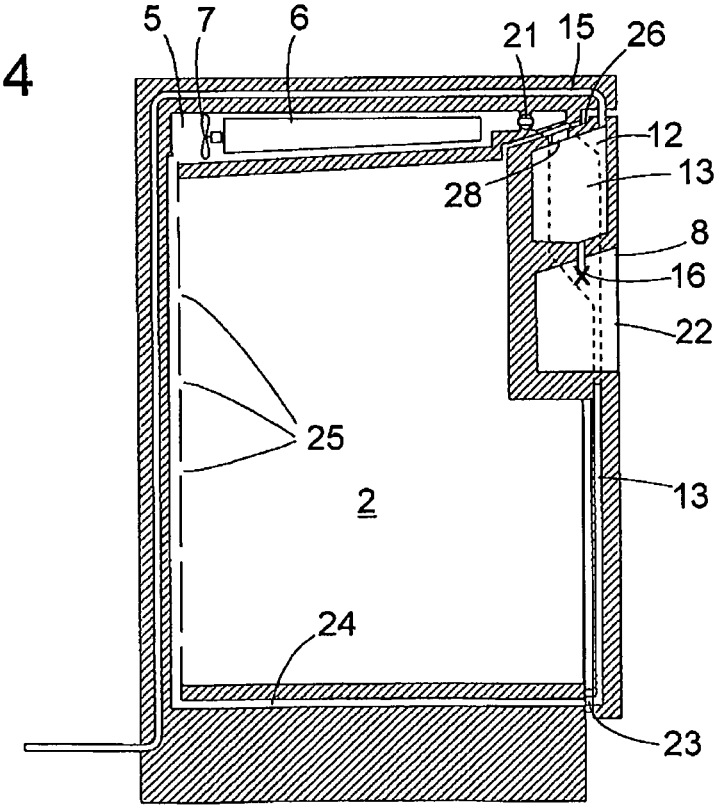
FIG. 4 shows a section according to a fourth embodiment.

In the embodiment shown in FIG. 4, the flow direction of the air in the chamber 5 is from back to front, in contrast to the embodiments considered above. Distributor channels 20 (see FIG. 5) for distributing cold air from the chamber 5 in the storage compartment 2 extend outside of the sectional plane of FIG. 4 in the door 8 and for reasons of clarity are not shown in FIG. 4. A valve 21 is switchable between a position in which it connects the distributor channels 20 with the chamber 5 and a position in which it feeds a reservoir cooling duct 13 running in the inside of the door 8. Parts of the reservoir cooling duct 13 which lie outside of the sectional plane of FIG. 4 are shown in the figure as a dashed outline. The reservoir cooling duct 13 runs along lateral walls of the reservoir 12, passes a recess 22 which is located under the reservoir and contains the water dispenser 16, and extends finally as far as a transition piece 23 at the bottom edge of the door 8, to which bottom edge an intake duct 24 is joined in the carcass 1. Said intake duct 24 extends under the base of the storage compartment 2 and along its rear wall. Intake apertures 25 formed in the area of the rear wall between intake duct 24 and storage compartment 2 enable air to be recirculated from the storage compartment 2 to the evaporator chamber 5.

Figure 5:
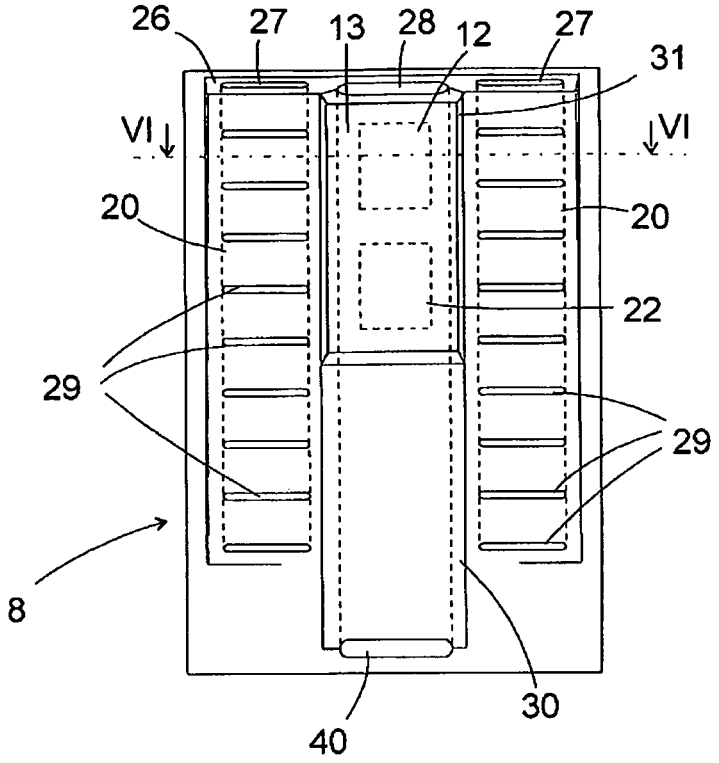
FIG. 5 shows a view of the inside of the door of the refrigeration appliance from FIG. 4.

FIG. 5 shows a view of the rear side of the door 8. Located in an inclined surface 26 in the upper region of the door are three openings 27, 27, 28, opposite which are located corresponding openings of the carcass 1 when the door 8 is closed, and of which in a first position of the valve 21 the two outer openings 27 are fed with cold air and in a second position of the valve 21 the middle opening 28 is fed with cold air. The two openings 27 belong to distributor channels 20 which extend vertically downward along the inside of the door 8 and in each case have a plurality of outlet apertures 29 at different heights via which cold air is delivered in a distributed manner over the height of the storage compartment 2.

The opening 28 belongs to the reservoir cooling duct 13 that runs between the two distributor channels 20 and the outline of which, hidden in the figure, is likewise indicated in the drawing by a dashed line. The reservoir cooling duct 13 is delimited from the storage compartment 2 by a flat plastic shell 30 which extends from the opening 28 over essentially the full height of the door as far as an opening 40 at its bottom edge and in its upper region has a bulge 31 projecting into the storage compartment 2 and concealing both the reservoir 12 and the recess 22.

Figure 6:
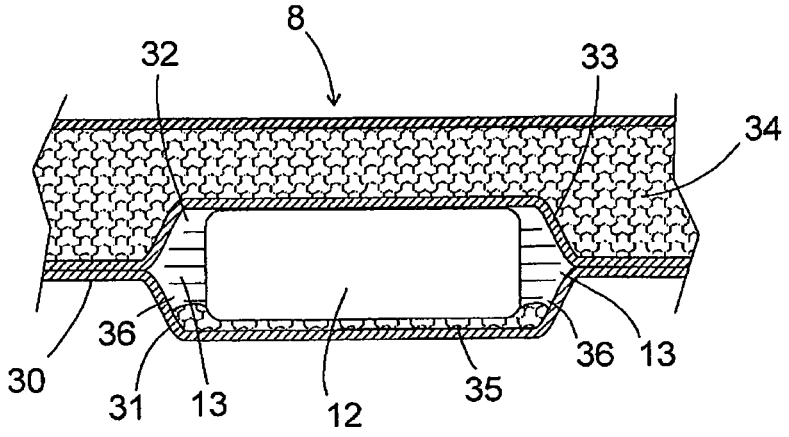
FIG. 6 shows a partial section along the line VI-VI from FIG. 5.

As can be seen more precisely in the section shown in FIG. 6, the door 8, like the carcass, is constructed from a solid outer skin, an inner wall 33 deep-drawn from plastic and, enclosed therebetween, a layer 34 of insulating foam material and has a cavity 32 covered by the shell 30 and in which the reservoir 12 is housed. In the schematic shown in FIG. 6, the reservoir cooling duct 13 extends on both sides of the reservoir 12 at an angle 36 which is delimited on one side by side walls of the reservoir 12 and on the other side by the shell 31 which separates the cooling duct 13 from the storage compartment 2. A gap 35 between the reservoir 12 and the shell 31 is filled with insulating material in order to decouple the reservoir 12 thermally from the storage compartment 2 to a large extent. The gap 35 could also be left empty, however, in order to act equally as the reservoir cooling duct 13.

In order to intensify the heat exchange between the reservoir 12 and the air flowing in the cooling duct 13, the reservoir 12 can be provided with projecting cooling fins 37, as shown.

Because of the arrangement of the reservoir 12 in one of the insulating walls of the refrigeration appliance housing between the cooled storage compartment 2 and the environment, the reservoir 12 takes on a temperature which lies between that of the storage compartment 2 and that of the environment, without the necessity for the cooling duct 13 to be impinged upon by cold air. Supplying the duct 13 with cold air is only necessary if a lower temperature of the water in the reservoir is desired than ensues automatically in the thermal equilibrium between storage compartment and environment, or if a fast cooling-down of the reservoir contents is desired. In order to ensure the latter, the temperature of the water in the reservoir can, as explained above, be measured with the aid of a temperature sensor (not shown) and the cooling duct 13 impinged upon by cold air if the measured temperature lies above a setpoint value; it is, however, also possible to detect that or register how much water is being drawn off at the drinking water dispenser 16 in order subsequently to feed a fixed amount of cold air or an amount proportional to the drawn-off water volume into the cooling duct 13 and so quickly cool down water that has flowed in to replenish the reservoir 12. Controlling the cooling of the reservoir 12 in such a manner can be implemented economically in particular in refrigeration appliances that are equipped with an integrated water filter and a measuring apparatus for recording the accumulated water throughput through the filter. A measuring apparatus of said kind traditionally serves for estimating, on the basis of the water consumption, when the filter is exhausted and has to be replaced; however, it can also be readily used for qualitatively or quantitatively estimating the cooling requirement at the water reservoir 12.

The invention claimed is:

1. A refrigeration appliance comprising:

a heat-insulating housing;

a storage compartment for refrigerated items, the storage compartment being located in the heat-insulating housing;

a door to selectively close the storage compartment;

a water reservoir disposed outside of the storage compartment;

a blower for propelling a cold air stream sourced from an evaporator; and a distributor device, the distributor device being operable to distribute the cold air stream in a controlled manner between at least two circulation paths, with a first path of the circulation paths being in closer thermal contact with the water reservoir than a second path of the circulation paths, wherein the distributor device is upstream of both the first path and the second path, wherein the two circulation paths are positioned within the door.

2. A refrigeration appliance as claimed in claim 1, wherein the second path includes a plurality of distribution channels each having an opening in communication with the cold air stream and a plurality of outlet aperture in communication with the storage compartment.

3. A refrigeration appliance as claimed in claim 1, wherein the first path includes an inlet opening and an outlet opening.

4. A refrigeration appliance as claimed in claim 3, wherein the inlet opening and the outlet opening are positioned on the door.

5. A refrigeration appliance as claimed in claim 4, wherein the inlet opening is positioned adjacent a top of the door and an outlet opening is positioned adjacent a bottom of the door, such that the first path substantively spans an entire height of the door.

6. A refrigeration appliance as claimed in claim 4, wherein the outlet opening is positioned opposite an intake duct provided on the housing.

7. A refrigeration appliance as claimed in claim 1, wherein the reservoir is positioned within the door, within an interior shell of the door separating the reservoir from the storage compartment.

8. A refrigeration appliance as claimed in claim 1, wherein the door includes a recess equipped with a dispenser.

9. A refrigeration appliance as claimed in claim 8, wherein the reservoir is positioned above the recess.

10. A refrigeration appliance as claimed in claim 1, wherein the first path and the second path run parallel to one another within the door.

11. A refrigeration appliance as claimed in claim 1, wherein the first path surrounds at least three sides of the reservoir, as seen in cross section.

12. A refrigeration appliance comprising:

a heat-insulating housing;

a storage compartment for refrigerated items, the storage compartment being located in the heat-insulating housing;

a door to selectively close the storage compartment;

a water reservoir disposed outside of the storage compartment;

a blower for propelling a cold air stream sourced from an evaporator; and a distributor device, the distributor device being operable to distribute the cold air stream in a controlled manner via at least two circulation paths positioned within the door, with a first path of the circulation paths being in closer thermal contact with the water reservoir than a second path of the circulation paths, wherein the door includes a recess equipped with a dispenser and the first path extends past the recess and the reservoir.

13. A refrigeration appliance comprising:

a heat-insulating housing;

a storage compartment for refrigerated items, the storage compartment being located in the heat-insulating housing;

a door to selectively close the storage compartment;

a water reservoir disposed outside of the storage compartment;

a blower for propelling a cold air stream sourced from an evaporator; and a distributor device, the distributor device being operable to distribute the cold air stream in a controlled manner via at least two circulation paths positioned within the door, with a first path of the circulation paths being in closer thermal contact with the water reservoir than a second path of the circulation paths, wherein the first path and the second path run parallel to one another within the door and the second path includes two distribution channels, one on each side of the first path.

14. A refrigeration appliance comprising:

a heat-insulating housing;

a storage compartment for refrigerated items, the storage compartment being located in the heat-insulating housing;

a door to selectively close the storage compartment;

a water reservoir disposed outside of the storage compartment;

a blower for propelling a cold air stream sourced from an evaporator; and a distributor device, the distributor device being operable to distribute the cold air stream in a controlled manner via at least two circulation paths positioned within the door, with a first path of the circulation paths being in closer thermal contact with the water reservoir than a second path of the circulation paths, wherein the first path is configured to recirculate the cold air stream back to the evaporator, without passing through the storage compartment.

* * * * *